US009472863B2

(12) United States Patent
Ozaki

(10) Patent No.: US 9,472,863 B2
(45) Date of Patent: Oct. 18, 2016

(54) FLAT-CABLE CONNECTION STRUCTURE

(71) Applicant: YAZAKI CORPORATION, Minato-ku, Tokyo (JP)

(72) Inventor: Masahito Ozaki, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/965,121

(22) Filed: Dec. 10, 2015

(65) Prior Publication Data

US 2016/0099508 A1 Apr. 7, 2016

Related U.S. Application Data

(63) Continuation of application No. PCT/JP2014/065640, filed on Jun. 12, 2014.

(30) Foreign Application Priority Data

Jun. 14, 2013 (JP) ..... 2013-125527

(51) Int. Cl.
*H01R 4/24* (2006.01)
*H01R 12/67* (2011.01)
*H01R 12/77* (2011.01)

(52) U.S. Cl.
CPC ..... *H01R 4/2416* (2013.01); *H01R 4/2433* (2013.01); *H01R 12/675* (2013.01); *H01R 12/771* (2013.01); *H01R 12/772* (2013.01)

(58) Field of Classification Search
CPC .. H01R 12/77; H01R 12/771; H01R 12/772; H01R 12/774; H01R 12/777; H01R 12/778; H01R 12/78; H01R 12/79; H01R 12/675; H01R 4/2433; H01R 4/2429; H01R 4/2425
See application file for complete search history.

(56) References Cited

U.S. PATENT DOCUMENTS 4,260,209 A * 4/1981 Zell ..... H01R 12/675 29/842
4,892,489 A 1/1990 Hirai
4,938,711 A * 7/1990 Davis ..... H01R 12/675 439/405
5,338,221 A * 8/1994 Bowen ..... H01R 12/675 439/405
5,761,805 A * 6/1998 Guyer ..... H01R 13/6581 29/883
5,762,513 A * 6/1998 Stine ..... H01R 12/675 439/358
5,893,773 A * 4/1999 Dellinger ..... H01R 12/675 439/404
5,902,147 A * 5/1999 Jochen ..... H01R 12/675 439/405
5,964,620 A * 10/1999 Takahashi ..... H01R 9/0518 439/579
5,967,832 A * 10/1999 Ploehn ..... H01R 23/662 439/497
5,971,793 A * 10/1999 Jochen ..... H01R 12/778 439/405
5,980,303 A * 11/1999 Lee ..... H01R 12/675 439/405

(Continued)

FOREIGN PATENT DOCUMENTS

JP H02-037678 A 2/1990
JP 2001-250620 A 9/2001

(Continued)

*Primary Examiner* — Ross Gushi
(74) *Attorney, Agent, or Firm* — Mots Law, PLLC

(57) ABSTRACT

A holder has a flat cable insertion chamber for a flat cable to be inserted and a cutting blade penetration hole penetrating the flat cable insertion chamber. A jig has a cutting blade penetrating the cutting blade penetration hole of the holder with the flat cable inserted into the flat cable insertion chamber and forming a slit in a cover between a plurality of conductors of the flat cable.

3 Claims, 16 Drawing Sheets

(56) References Cited

U.S. PATENT DOCUMENTS 6,012,943 A * 1/2000 Wu ..... H01R 12/675 439/404
6,033,238 A * 3/2000 Fogg ..... H01R 12/675 439/108
6,062,896 A * 5/2000 Huang ..... H01R 12/675 439/405
6,062,907 A * 5/2000 Tan ..... H01R 13/65802 439/405
6,077,105 A * 6/2000 Jochen ..... H01R 12/675 439/405
6,120,319 A * 9/2000 Lee ..... H01R 12/675 439/405
6,179,642 B1 * 1/2001 Hwang ..... H01R 13/5804 439/358
6,193,541 B1 * 2/2001 Lee ..... H01R 12/675 439/358
6,193,545 B1 * 2/2001 Lee ..... H01R 12/675 439/497
6,203,359 B1 * 3/2001 Lee ..... H01R 13/5812 439/405
6,210,205 B1 * 4/2001 Huang ..... H01R 12/675 439/405
6,280,242 B1 * 8/2001 Jochen ..... H01R 12/675 439/405
6,309,243 B1 * 10/2001 Tu ..... H01R 12/675 439/101
6,368,148 B1 * 4/2002 Fogg ..... H01R 12/675 439/405
6,386,901 B1 * 5/2002 Caldwell ..... H01R 4/2404 439/404
6,533,607 B2 * 3/2003 Jochen ..... H01R 12/675 439/405
6,575,780 B1 * 6/2003 Lee ..... H01R 12/675 439/404
6,638,100 B2 * 10/2003 Fogg ..... H01R 12/675 439/405
6,645,002 B1 * 11/2003 Lee ..... H01R 12/675 439/404
6,666,706 B1 * 12/2003 Jones ..... H01R 13/506 439/353
6,676,444 B2 * 1/2004 Noro ..... H01R 12/592 439/497
6,761,576 B1 * 7/2004 Ye ..... H01R 4/2433 439/404
6,817,887 B2 * 11/2004 Jones ..... H01R 13/6275 439/405
6,994,583 B1 * 2/2006 Chi-Te ..... H01R 4/2433 439/404
7,351,100 B2 * 4/2008 Yodogawa ..... H01R 12/67 439/579
7,841,890 B2 * 11/2010 Chen ..... H01R 12/675 439/404
7,892,025 B2 * 2/2011 Daily ..... H01R 13/504 439/606
2001/0019919 A1 9/2001 Mochizuki et al.
2005/0164542 A1 * 7/2005 Wu ..... H01R 12/675 439/387
2007/0054540 A1 * 3/2007 Takeda ..... H01R 12/592 439/404
2016/0099508 A1 * 4/2016 Ozaki ..... H01R 12/772 439/395
2016/0134034 A1 * 5/2016 Neu ..... H01R 13/6335 439/152

FOREIGN PATENT DOCUMENTS

JP 2004-311268 A 11/2004
JP 2005-050718 A 2/2005
JP 2005-190717 A 7/2005
JP 2010-208405 A 9/2010

* cited by examiner

FLAT-CABLE CONNECTION STRUCTURE

CROSS REFERENCE TO RELATED APPLICATION

This application is a Continuation of PCT Application No. PCT/JP2014/065640, filed on Jun. 12, 2014, and claims the priority of Japanese Patent Application No. 2013-125527, filed on Jun. 14, 2013, the content of both of which is incorporated herein by reference.

BACKGROUND

1. Technical Field

The present invention relates to a connection structure for connecting a flat cable (FC) to a terminal.

2. Related Art

Japanese Unexamined Patent Application Publication No. 2010-208405 proposes a flat-cable connection structure.

In FIG. 1, a connection structure for a flat cable 100 is applied to a vehicle interior lamp 110. That is, in the vehicle interior lamp 110, an insulation displacement terminal portion (not illustrated) is provided. The flat cable 100 includes a plurality of conductors 101 arranged in parallel to each other at spaced intervals, and an insulating cover 102 covering the conductors 101. Slits 103 are formed at a part of the cover 102 between the conductors 101. An insulation displacement terminal portion is stuck in the part of the conductors 101 in an area in which the slits 103 are formed, and the insulation displacement terminal portion is brought into pressure contact with the conductors 101.

The slits 103 formed between the conductors 101 in the flat cable 100 can absorb the difference between the pitch of the conductors 101 and the pitch of the insulation displacement terminal portions, and the flat cable 100 is reliably connected.

SUMMARY

However, a process of forming the slits 103 in the flat cable 100 needs to be separately performed before a process of assembly to the vehicle interior lamp 110, and the process takes time and effort. Further, formation of the slits requires an expensive dedicated processing apparatus. Still further, since the flat cable 100 in which the slits 103 are formed tends to loosen at a part of the slits 103, assembling thereof is difficult.

The purpose of the present invention is to provide a flat-cable connection structure which does not require an expensive dedicated processing apparatus to slit a flat cable, and facilitates assembling of the flat cable.

A flat-cable connection structure in accordance with some embodiments includes: a flat cable having a plurality of conductors spaced from each other and a cover covering the plurality of conductors; a housing; a holder having a flat cable insertion chamber for the flat cable to be inserted and a cutting blade penetration hole penetrating the flat cable insertion chamber; an insulation displacement terminal portion fixed to the housing through the holder and sticking in the flat cable inserted into the flat cable insertion chamber; and a jig having a cutting blade penetrating the cutting blade penetration hole of the holder with the flat cable inserted into the flat cable insertion chamber and forming a slit in the cover between the plurality of conductors of the flat cable. The insulation displacement terminal portion sticking in the flat cable having the slit formed by the cutting blade is in pressure-contact with a corresponding conductor of the plurality of conductors.

The slit may be formed in a range including an area in which the insulation displacement terminal portion is in pressure-contact with the corresponding conductor of the plurality of conductors.

The jig may further include: a base having the cutting blade standing upright; a front wall standing upright at a front end of the base and positioning the holder; and a pair of side walls standing upright at both side ends of the base and positioning the holder.

According to the above-mentioned configuration, when the flat cable is inserted into a flat cable insertion chamber of a holder, a cutting blade penetrating a cutting blade penetration hole of the holder forms a slit in the flat cable in the flat cable insertion chamber. Accordingly, the slit can be formed in the flat cable without need for an expensive dedicated slitting apparatus, and cost can be reduced. Further, before insertion, a terminal end of the flat cable is not cut and not loosened, so that assembly of the flat cable to the holder is facilitated.

DETAILED DESCRIPTION

Figure 1:
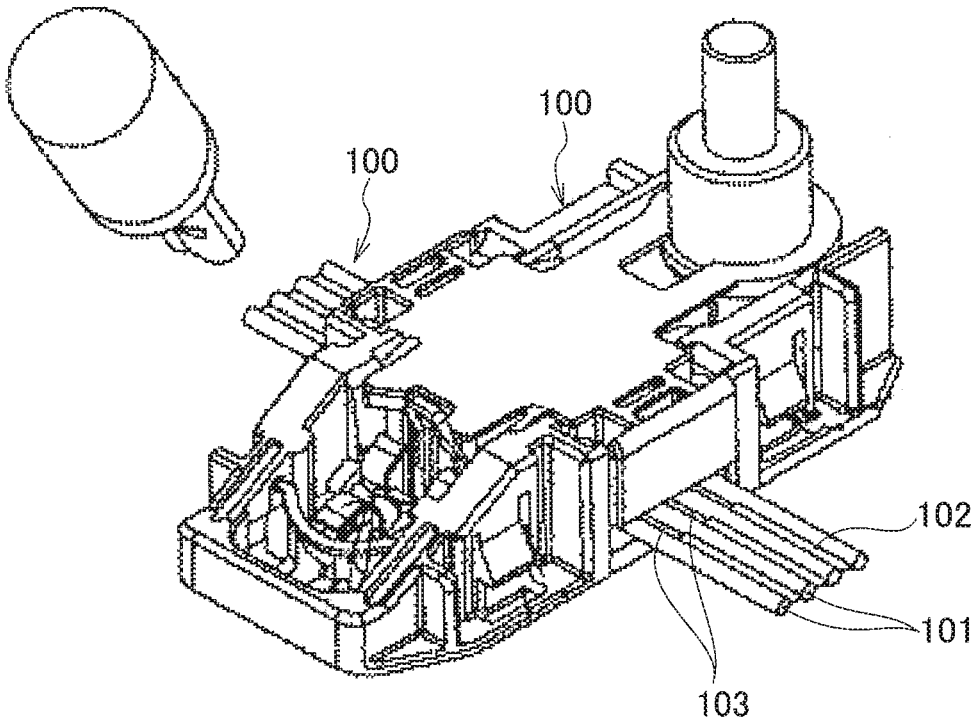
FIG. 1 RELATED ART
FIG. 1 is a perspective view of a vehicle interior lamp to which a flat cable connection structure according to a related art is applied.
Figure 2A:
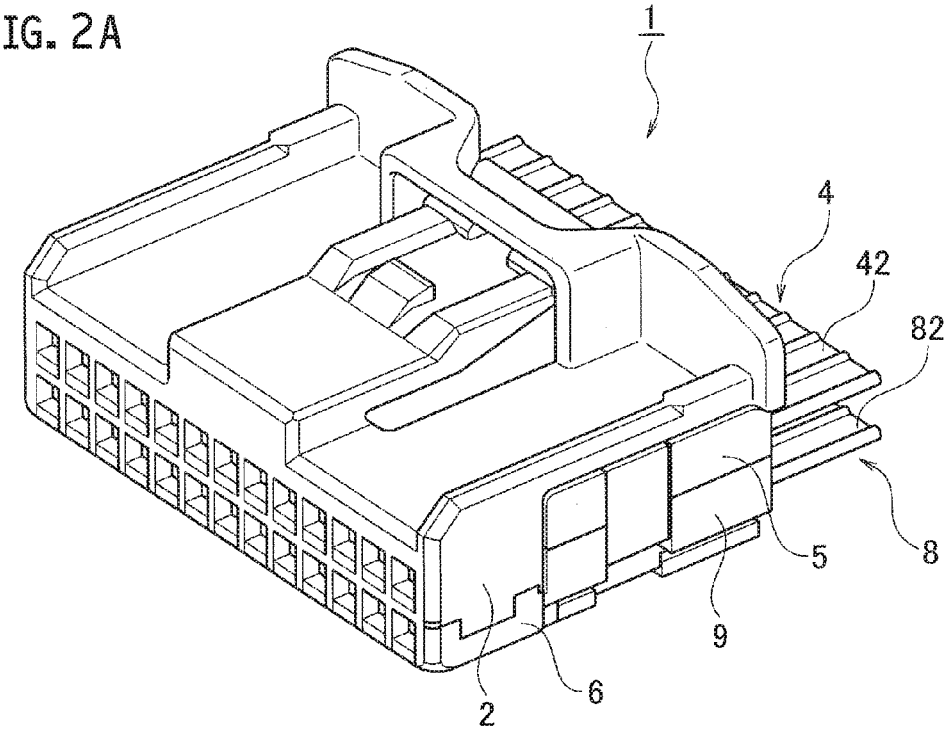
FIG. 2A is a perspective view of a connector according to an embodiment of the present invention.
Figure 2B:
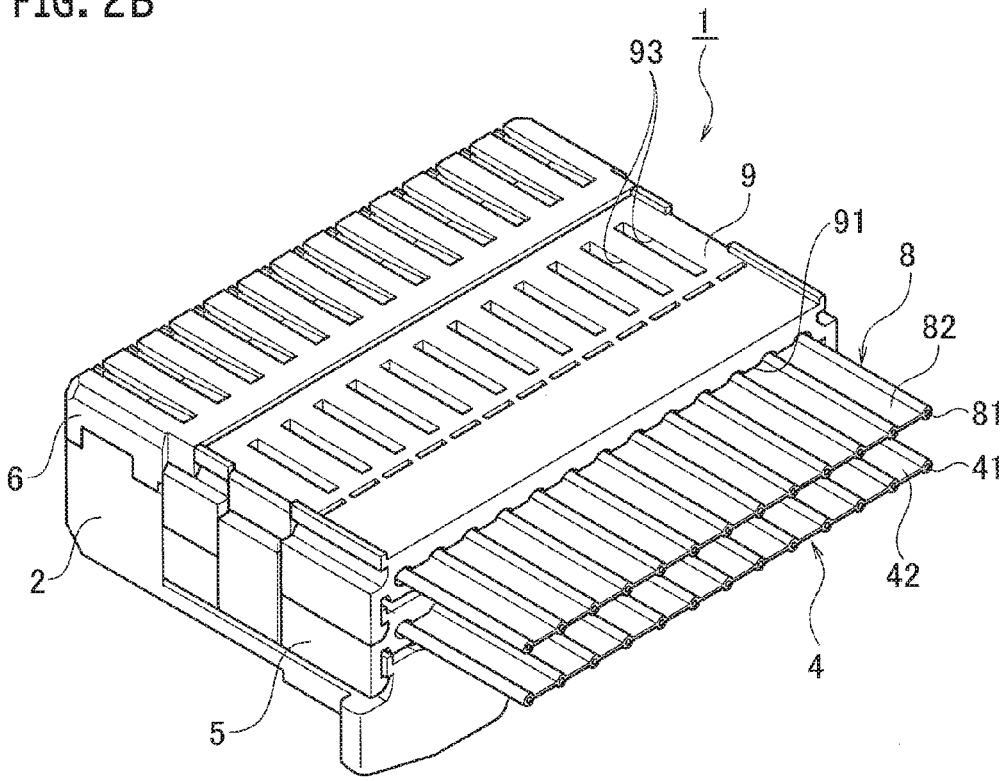
FIG. 2B is a perspective view of the connector viewed from the opposite side of FIG. 2A.
Figure 3:
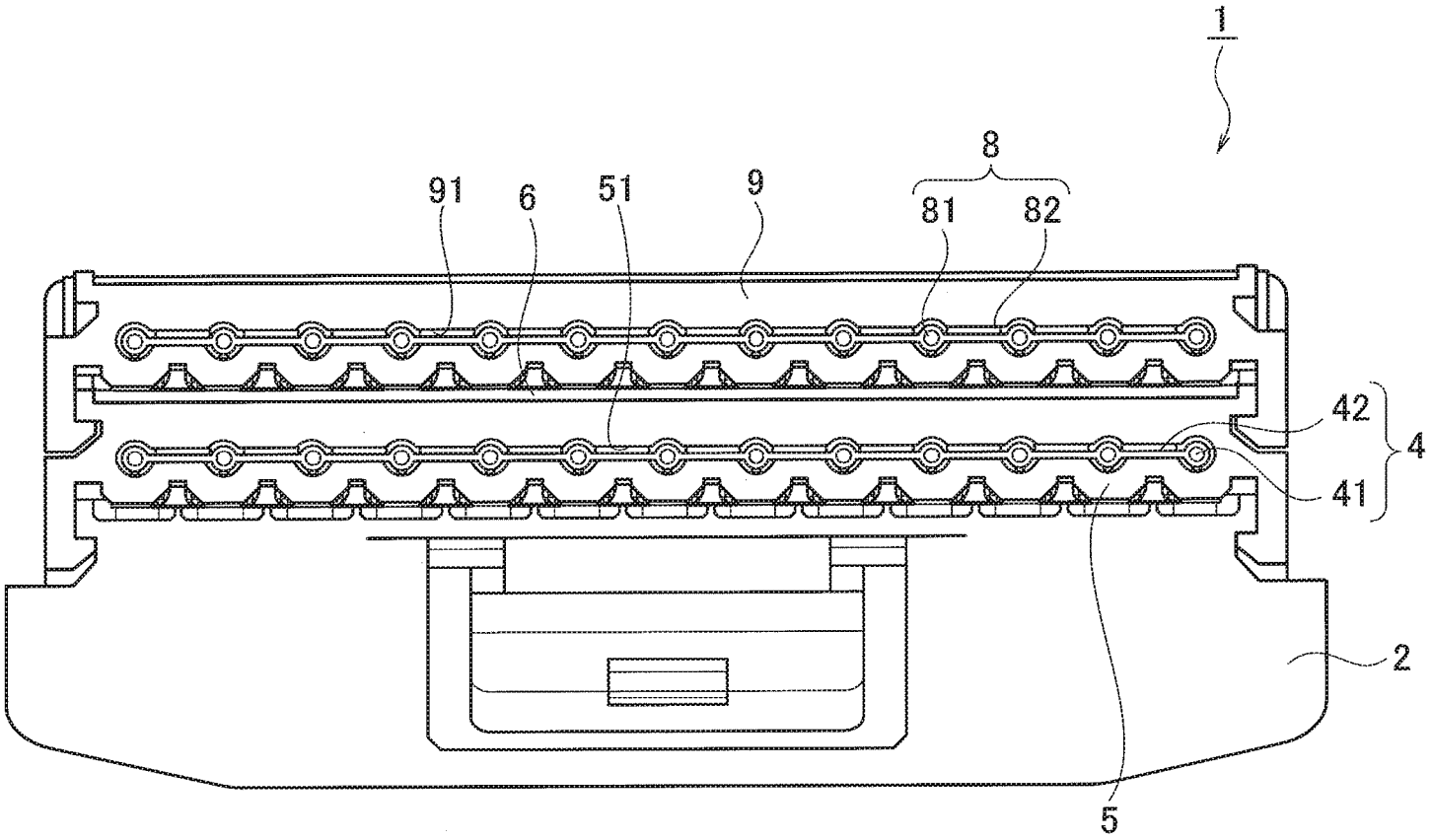
FIG. 3 is a back side view of the connector according to an embodiment of the present invention.
Figure 4:
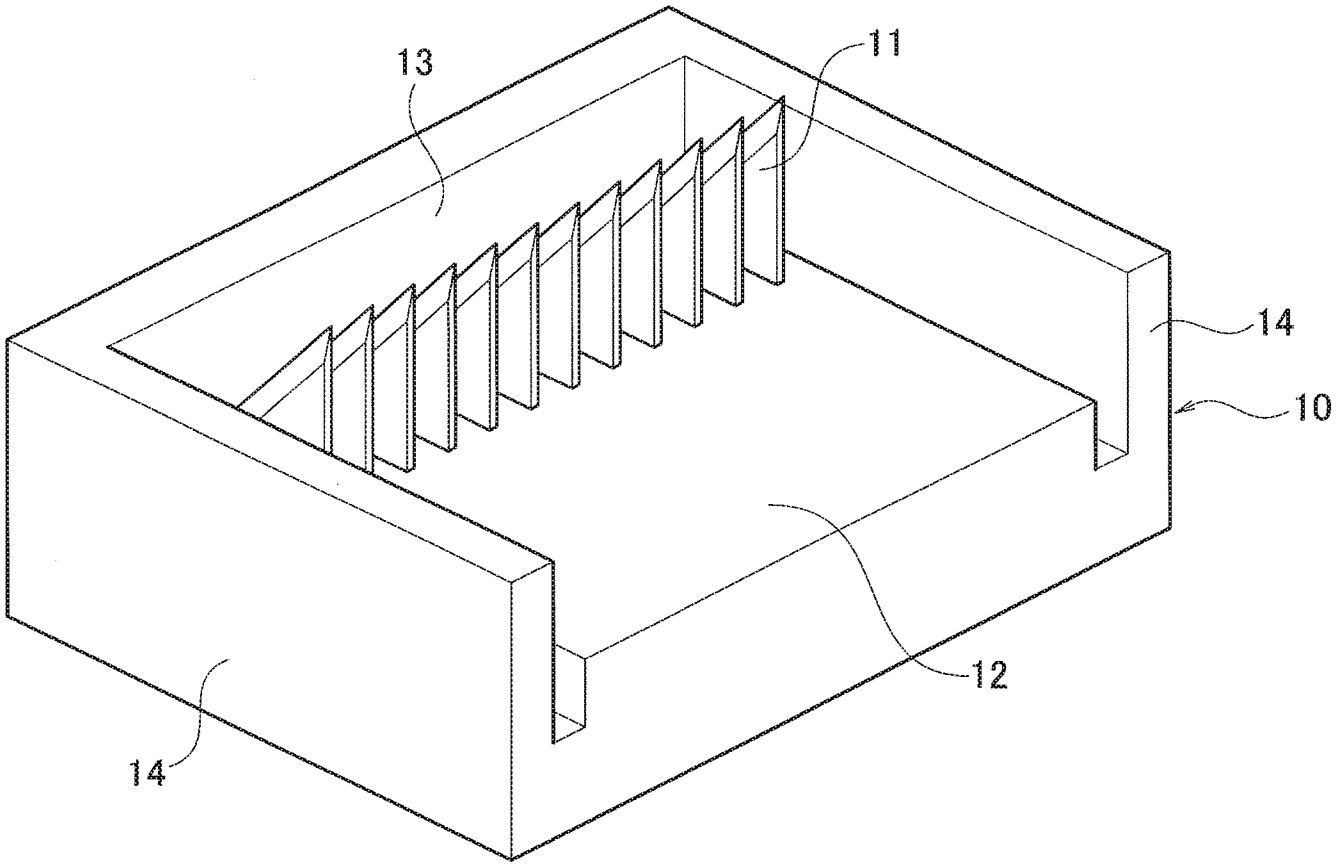
FIG. 4 is a perspective view of a jig including cutting blades according to an embodiment of the present invention.
Figure 5:
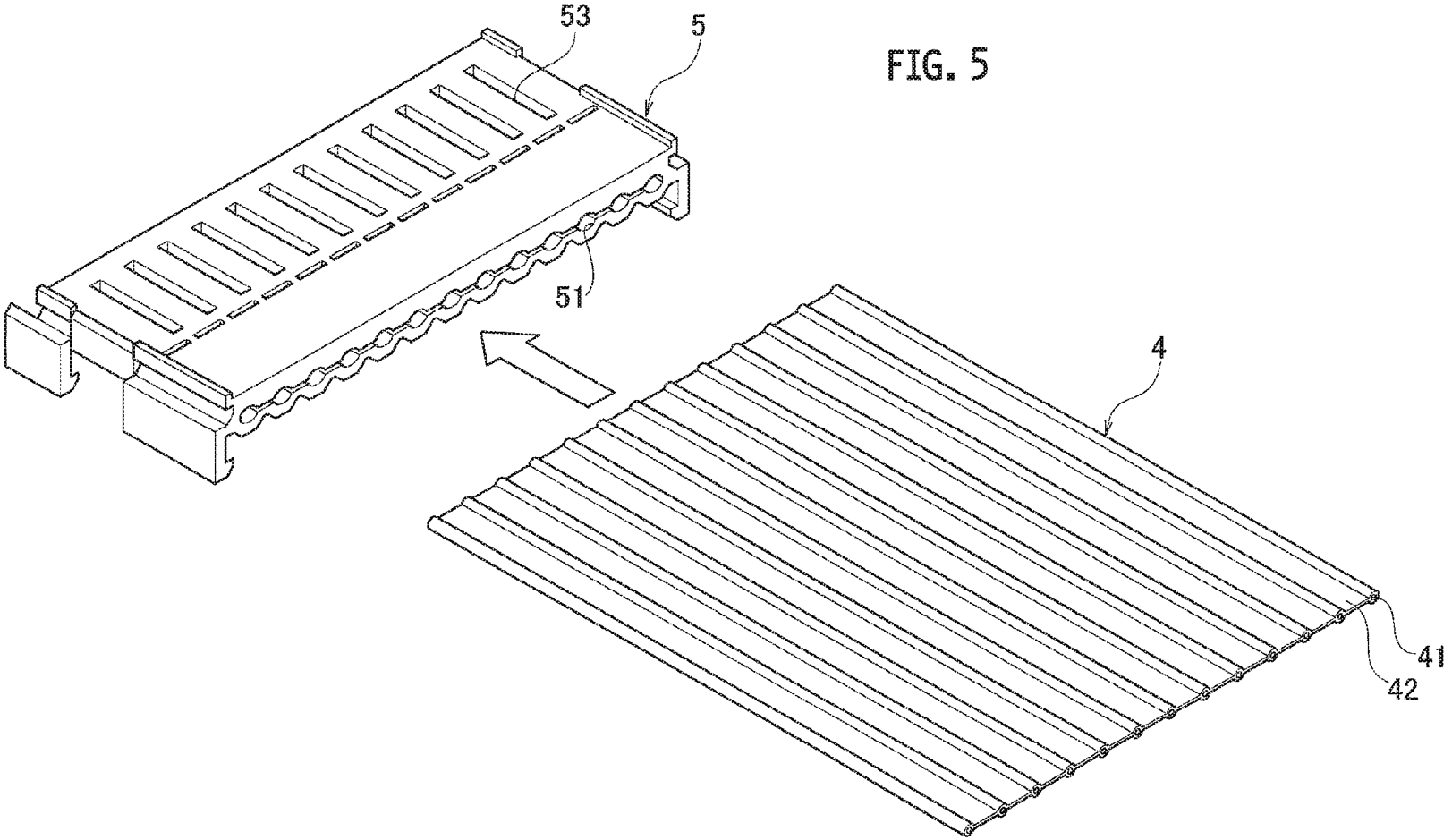
FIG. 5 is a perspective view illustrating a process of assembling a first flat cable to a first holder, according to an embodiment of the present invention.
Figure 6:
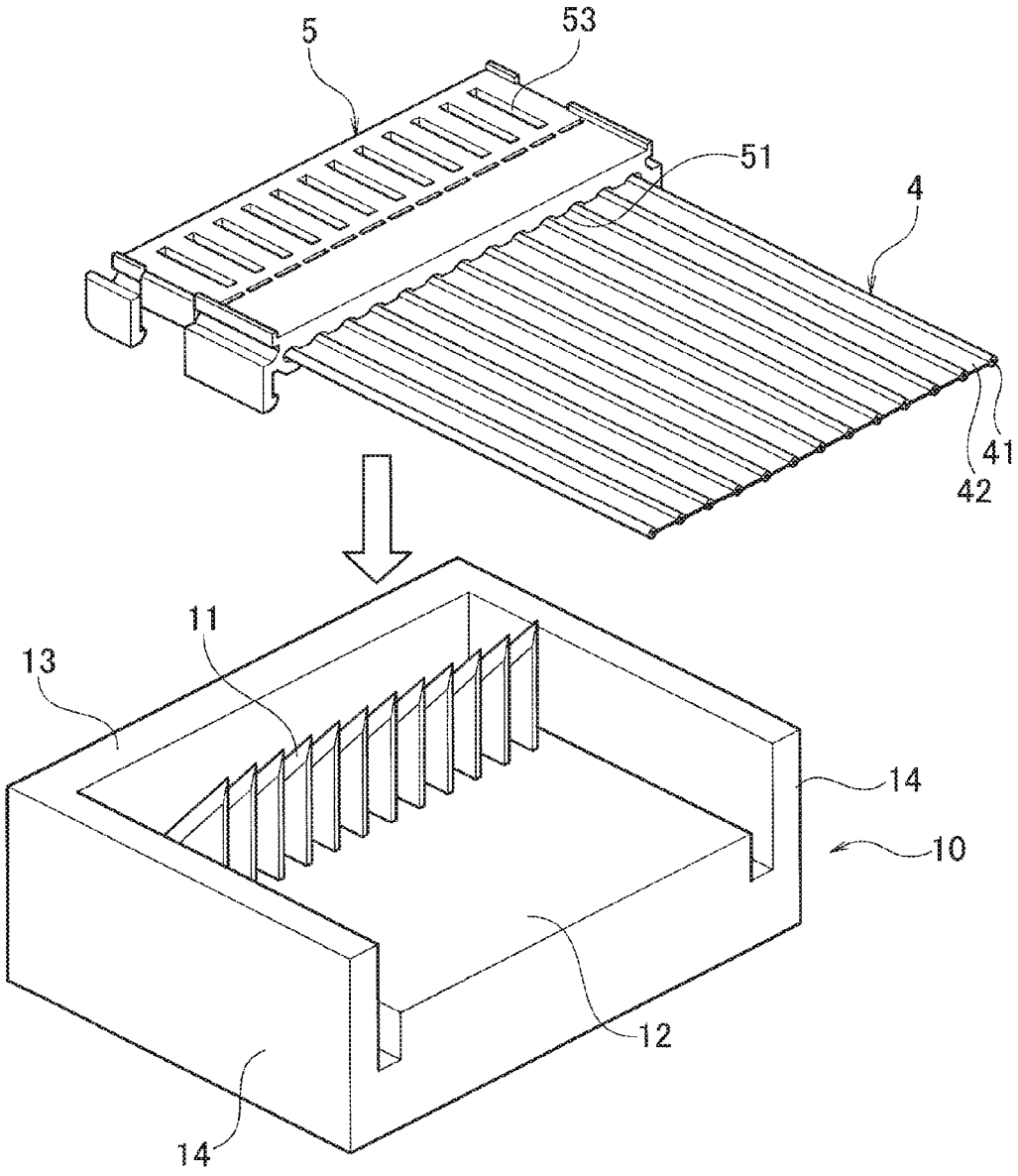
FIG. 6 is a perspective view illustrating a process of forming slits in a first flat cable, according to an embodiment of the present invention.
Figure 7A:
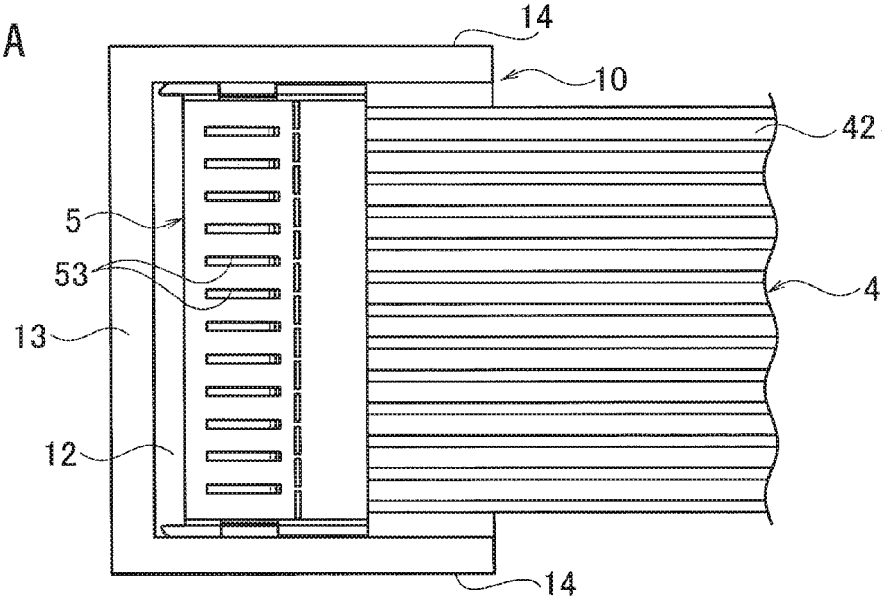
FIG. 7A is a plan view of a state forming slits in a first flat cable according to an embodiment of the present invention.
Figure 7B:
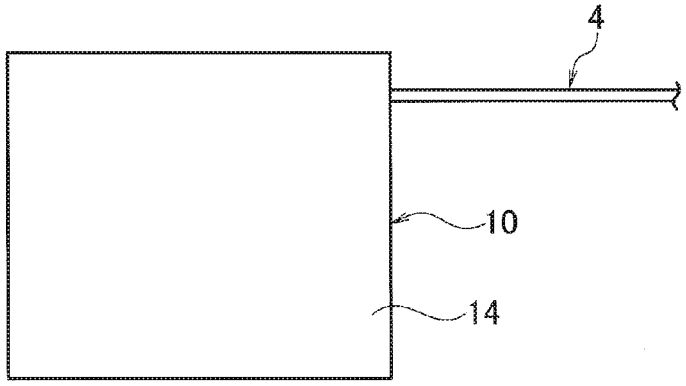
FIG. 7B is a side view of a state forming the slits in the first flat cable according to an embodiment of the present invention.
Figure 7C:
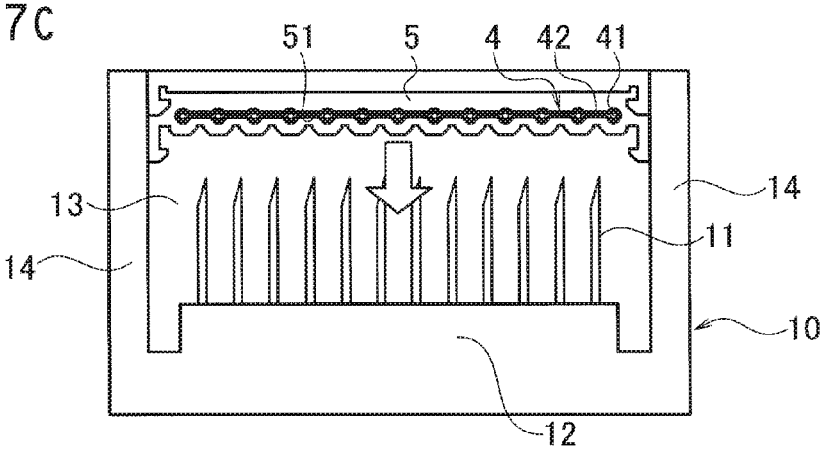
FIG. 7C is a front view of a state forming the slits in the first flat cable according to an embodiment of the present invention.
Figure 8A:
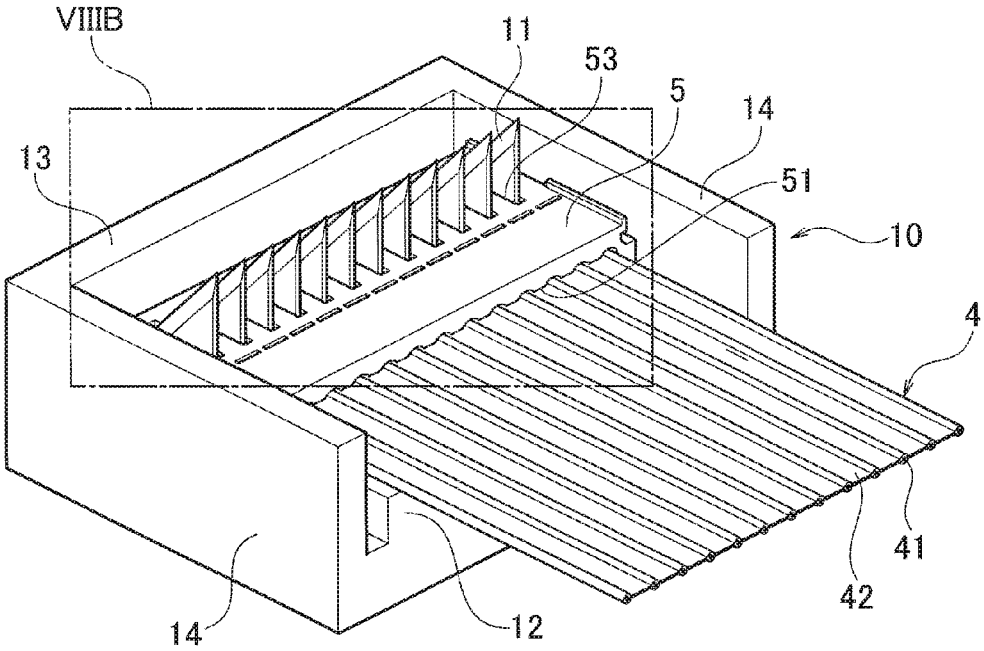
FIG. 8A is a perspective view of a state in which slits are formed in a first flat cable by a jig, according to an embodiment of the present invention.
Figure 8B:
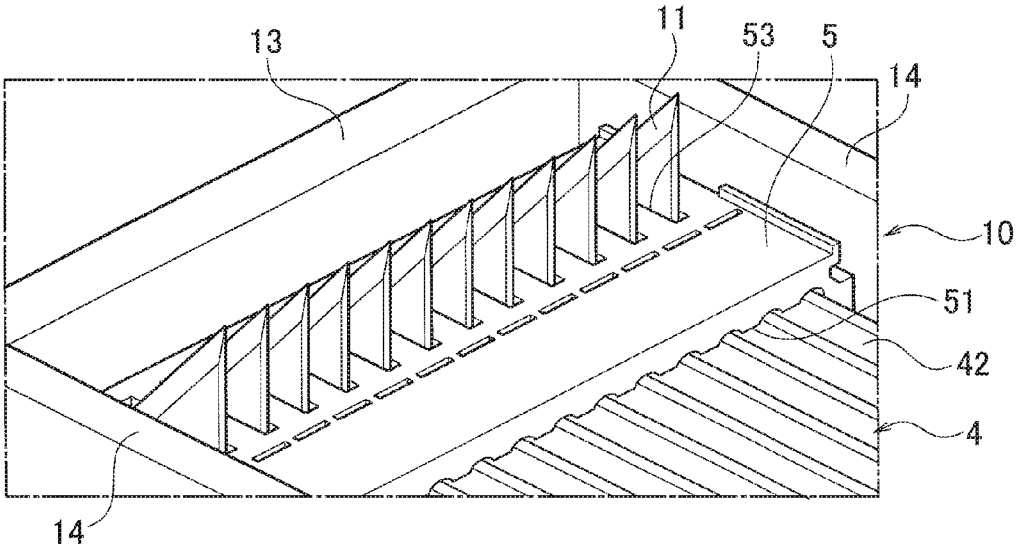
FIG. 8B is an enlarged perspective view of a portion VIIIB of FIG. 8A.
Figure 9:
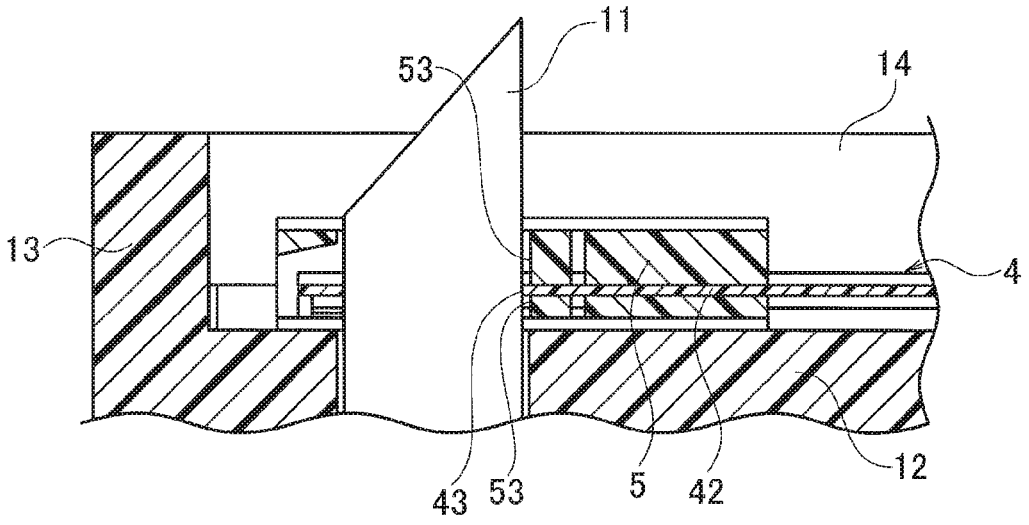
FIG. 9 is a cross-sectional view of a state in which cutting blade of a jig penetrates a first flat cable, according to an embodiment of the present invention.

An embodiment of the present invention will be described in detail below with reference to the drawings.

FIG. 2A to FIG. 16 illustrate an embodiment of the present invention. A connection structure for first and second flat cables (FC) 4 and 8 according to the present embodiment is applied to a connector 1 according to the present embodiment. Description will be made below.

The connector 1 includes a lower housing 2, a plurality of first terminals 3 fixed to the lower housing 2, a first flat cable (FC) 4 connected to the first terminals 3, a first holder 5 for holding the first flat cable 4, an upper housing 6 assembled to the lower housing 2 from above the first holder 5, a plurality of second terminals 7 fixed to the upper housing 6, a second flat cable (FC) 8 connected to the second terminals 7, and a second holder 9 for holding the second flat cable 8.

The lower housing 2 is provided with a plurality of terminal-storing chambers 2*a*. The plurality of terminal-storing chambers 2*a* are arranged in parallel at equal intervals.

Figure 12:
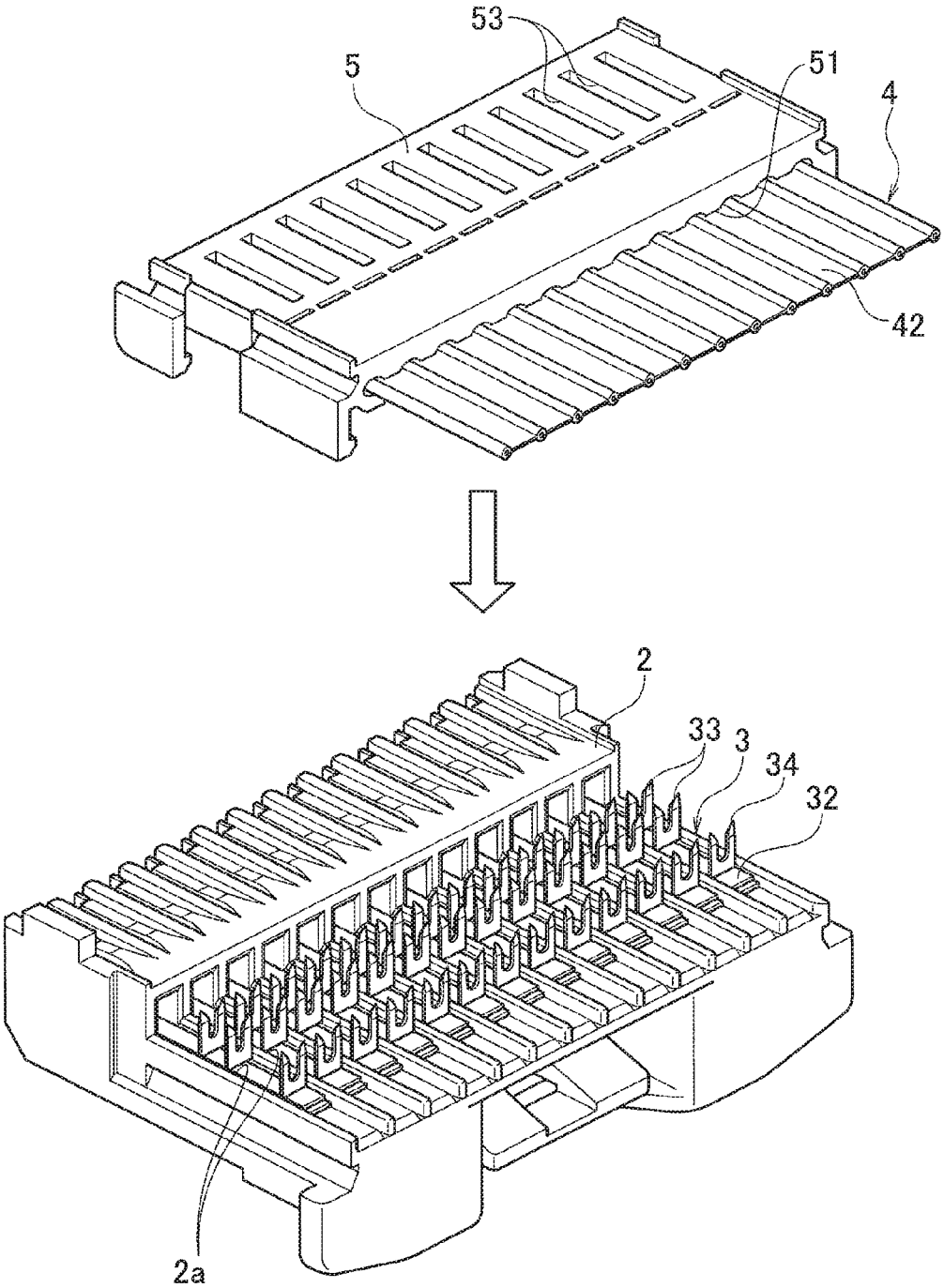
FIG. 12 is a perspective view illustrating a process of mounting a first holder with a flat cable to a lower housing, according to an embodiment of the present invention.

As illustrated in FIG. 12, the plurality of first terminals 3 are stored in the terminal-storing chambers 2*a* of the lower housing 2. Each of the first terminals 3 has a terminal connection portion (not illustrated) into which a mating terminal (not illustrated) is inserted, and a cable connection portion 32 connected to a rear side of the terminal connection portion, and the terminal connection portion and the cable connection portion 32 are integrally formed by bending an electrically-conductive metal (not illustrated) having a desired shape. The cable connection portion 32 has two insulation displacement terminal portions 33 and one clamping blade 34 which stand upright in a longitudinal direction at spaced intervals. Each of the insulation displacement terminal portions 33 has an insertion hole into which a conductor 41 of the first flat cable 4, described later, is inserted, for pressure-contact with the conductor 41. The clamping blade 34 has an insertion hole having a shape substantially the same as that of the insulation displacement terminal portion 33 but having a diameter larger than that of the conductor 41, and the clamping blade 34 is configured not to make pressure-contact with the conductor 41 but to stick only in a cover 42 of the first flat cable 4, described later.

The upper housing 6 is provided with a plurality of terminal-storing chambers 6*a*, similarly to the lower housing 2. The plurality of terminal-storing chamber 6*a* are arranged in parallel at equal intervals.

Figure 14:
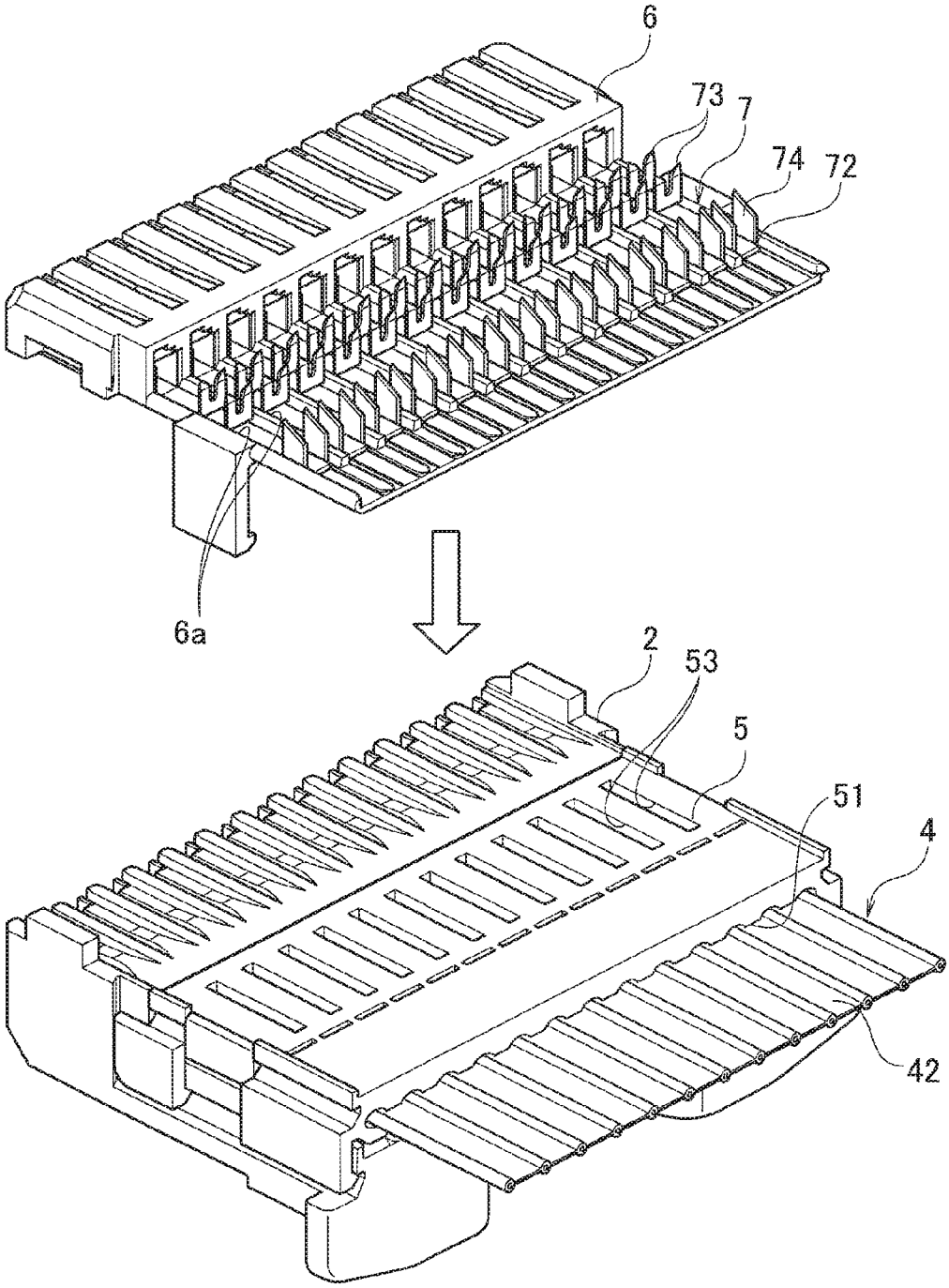
FIG. 14 is a perspective view illustrating a process of mounting an upper housing to a lower housing, according to an embodiment of the present invention.

As illustrated in FIG. 14 or the like, the plurality of second terminals 7 are stored in the terminal-storing chambers 6*a* of the upper housing 6. Each of the second terminals 7 has a terminal connection portion (not illustrated) into which a mating terminal (not illustrated) is inserted, and a cable connection portion 72 connected to a rear side of the terminal connection portion, and the terminal connection portion and the cable connection portion 72 are integrally formed by bending an electrically-conductive metal (not illustrated) having a desired shape. The cable connection portion 72 has two insulation displacement terminal portions 73 and two clamping blades 74 which stand upright in a longitudinal direction at spaced intervals. The insulation displacement terminal portion 73 has an insertion hole into which the conductor 41 is inserted for pressure-contact with the conductor 41. The clamping blades 74 are oriented in a direction different from that of the clamping blade 34 of the first terminal 3.

Figure 10A:
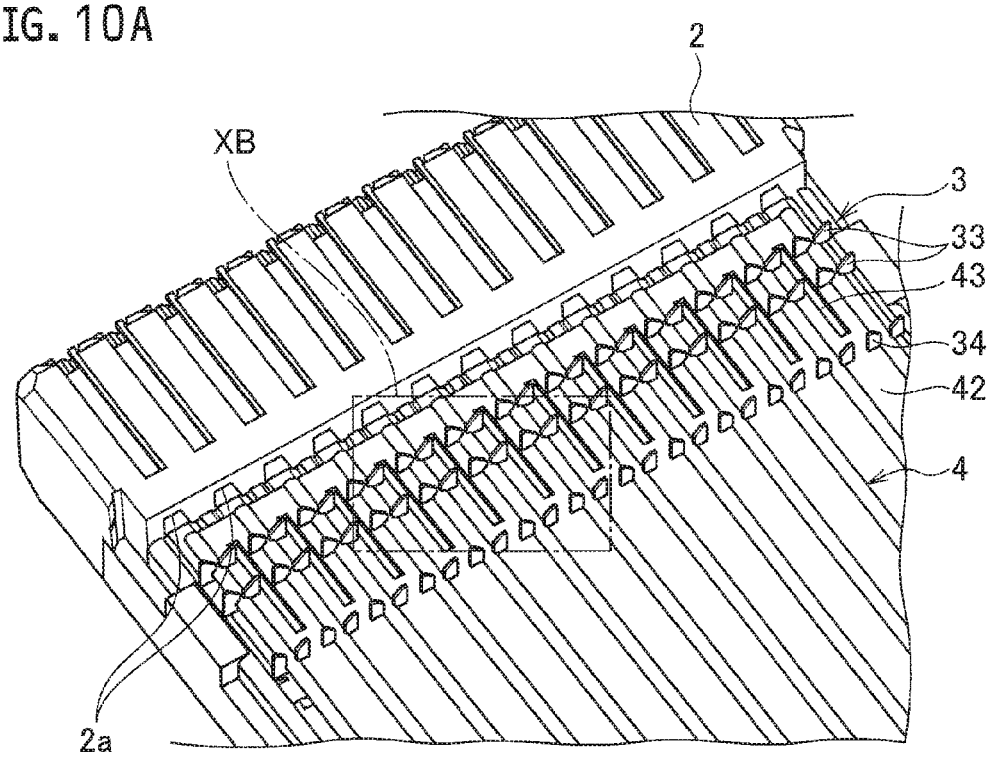
FIG. 10A is a perspective view of a state in which slits are formed in a first flat cable according to an embodiment of the present invention.
Figure 10B:
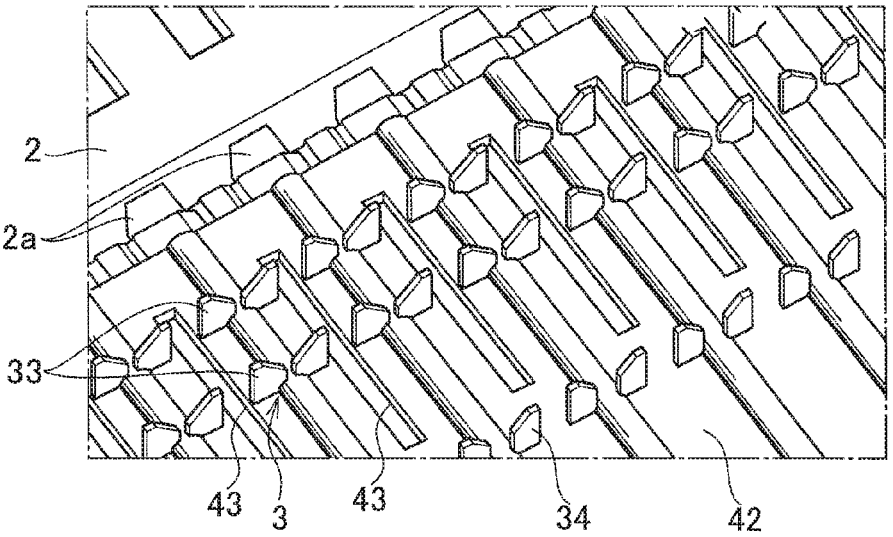
FIG. 10B is an enlarged perspective view of a portion XB of FIG. 10A.

Note that the first holder 5 is omitted from FIGS. 10A and 10B for clear description of a structure under the first holder 5 mounted on the lower housing 2.

The first flat cable 4 includes the plurality of conductors 41 arranged in parallel to each other at spaced intervals, and the insulating cover 42 covering the conductors 41, and the first flat cable 4 is formed into a flat shape. Similarly, the second flat cable 8 also includes a plurality of conductors 81 arranged in parallel to each other at spaced intervals, and an insulating cover 82 covering the conductors 81, and the second flat cable 8 is formed into a flat shape.

As illustrated in FIGS. 5 to 7C, the first holder 5 is provided with a flat cable insertion chamber 51 into which the first flat cable 4 is inserted, and a plurality of cutting blade penetration holes 53 penetrating the cable insertion chamber 51. A plurality of cutting blades 11 provided in a jig 10 are inserted through the cutting blade penetration holes 53.

The second holder 9 has a configuration substantially the same as that of the first holder 5. That is, the second holder 9 is provided with a flat cable insertion chamber 91 into which the second flat cable 8 is inserted, and a plurality of cutting blade penetration holes 93 penetrating the cable insertion chamber 91. The plurality of cutting blades 11 provided in the jig 10 are inserted through the cutting blade penetration holes 93.

As illustrated in FIGS. 4, 6, 8A, and 8B, the jig 10 has a base 12 on which the plurality of cutting blades 11 facing upward stand upright, a front wall 13 standing upright at a front end of the base 12, and a pair of side walls 14 standing upright at both side ends of the base 12.

Figure 11:
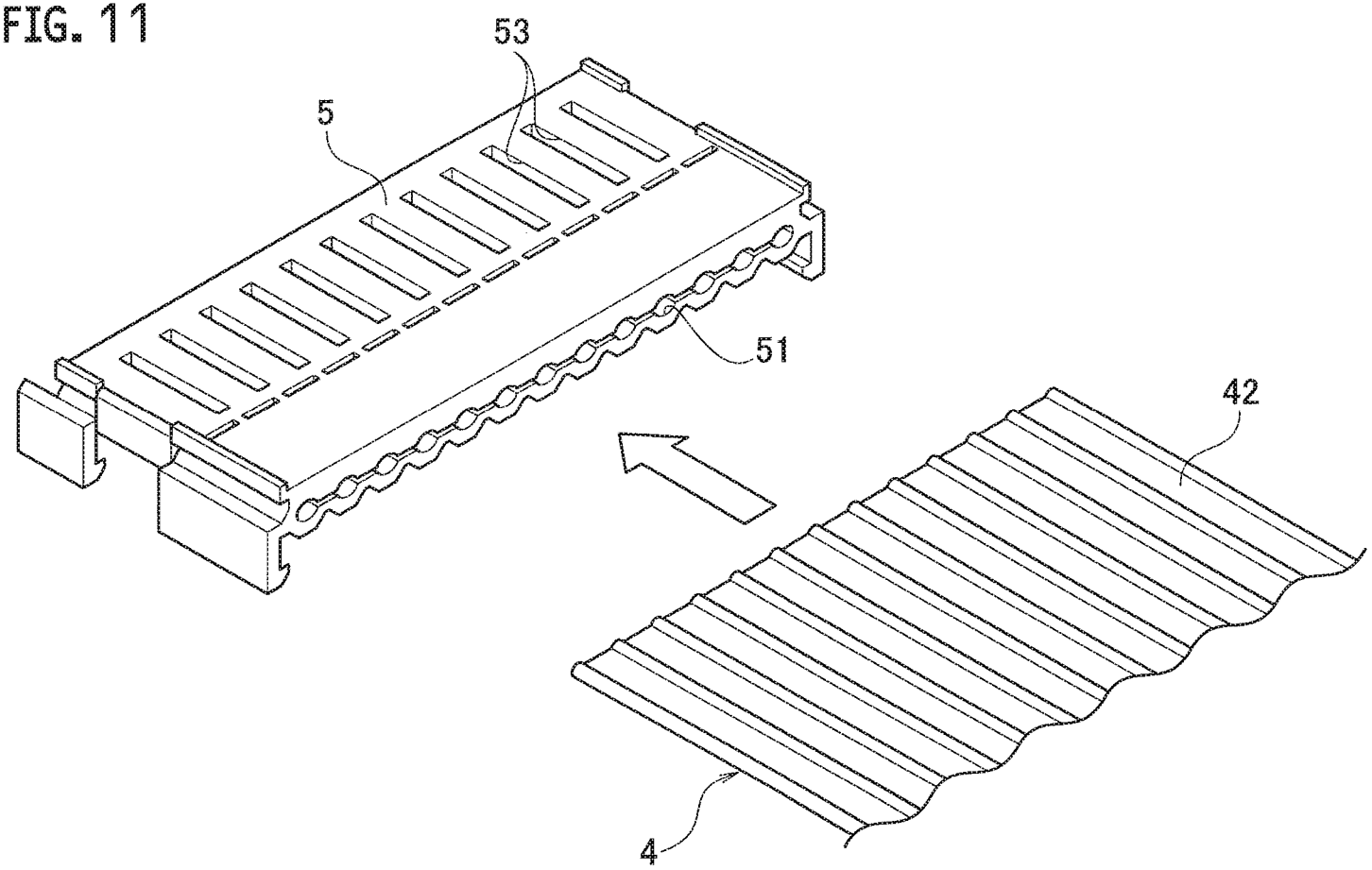
FIG. 11 is a perspective view illustrating a process of mounting a first flat cable to a first holder, according to an embodiment of the present invention.

Next, assembly work of the connector 1 will be described. First, as illustrated in FIG. 11, the first flat cable 4 is inserted into the flat cable insertion chamber 51 of the first holder 5. Next, as illustrated in FIG. 6 and FIGS. 7A to 7C, the first holder 5 with the first flat cable 4 is mounted to the jig 10 from above. In mounting, the first holder 5 is lowered while being positioned with the front wall 13 and the pair of side walls 14 of the jig 10. Then, the cutting blades 11 of the jig 10 are inserted into the cutting blade penetration holes 53 of the first holder 5 from below, a terminal portion of the cover 42 of the first flat cable 4 is cut, and slits 43 are formed. Each of the slits 43 is provided at a part of the cover 42 between adjacent conductors 41. Cuts (slits 43) of the cover 42 are formed in a range including an area in which the insulation displacement terminal portions 33 make pressure-contact with the conductors 41. Similarly, slits are also formed at a terminal end of the cover 82 of the second flat cable 8 by the jig 10.

Figure 13:
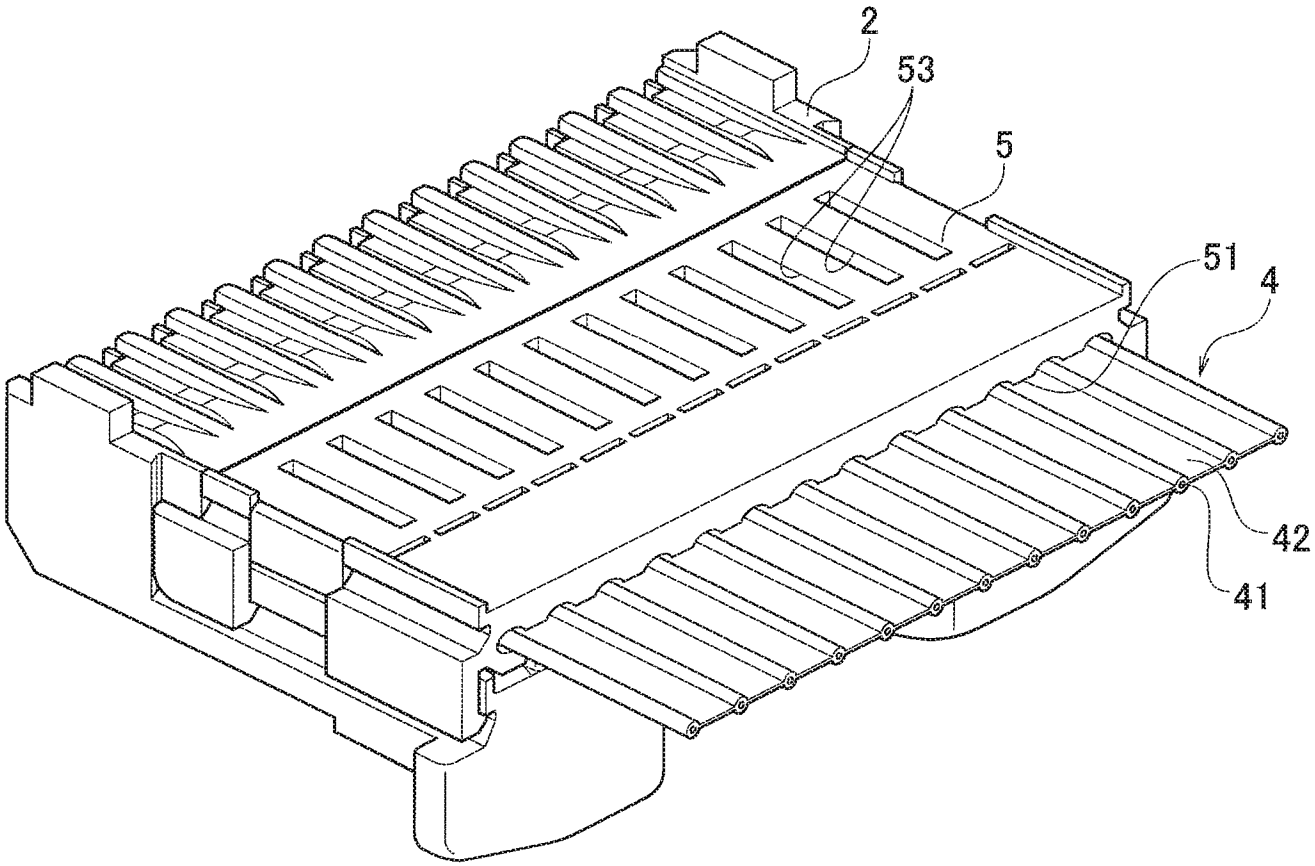
FIG. 13 is a perspective view of a lower housing to which a first holder with a flat cable is mounted, according to an embodiment of the present invention.

Next, as illustrated in FIG. 12, the first holder 5 is mounted to the lower housing 2. In the mounting, as illustrated in FIG. 13, the lower housing 2 with the first flat cable 4 held by the first holder 5 is obtained. At this time, the first flat cable 4 is brought into pressure-contact with the plurality of first terminals 3 by the first holder 5, and as illustrated in FIGS. 10A and 10B, the insulation displacement terminal portion 33 bites the conductor 41 through the cover 42 to be electrically connected.

Figure 15:
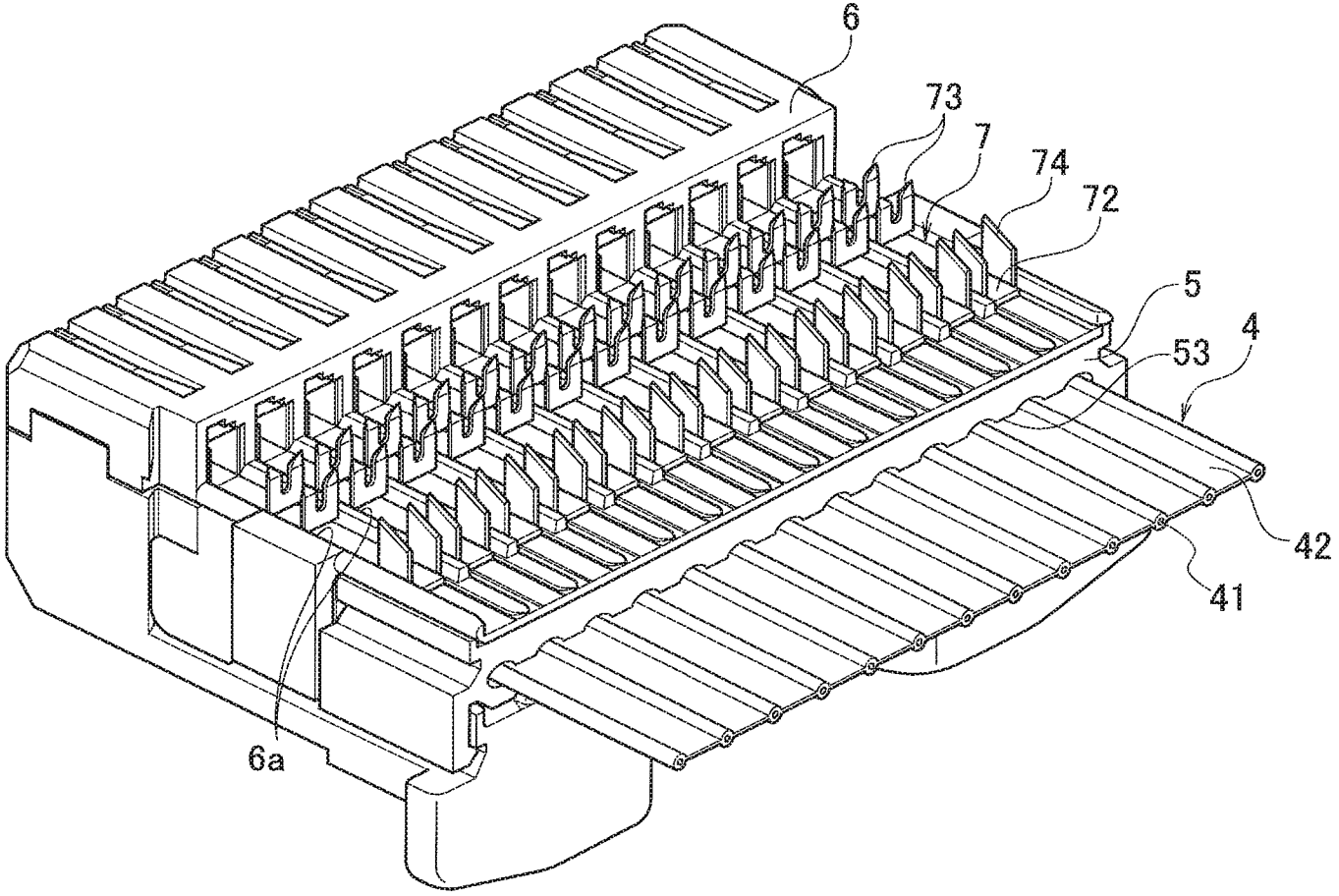
FIG. 15 is a perspective view of a lower housing and an upper housing integrated with each other, according to an embodiment of the present invention.
Figure 16:
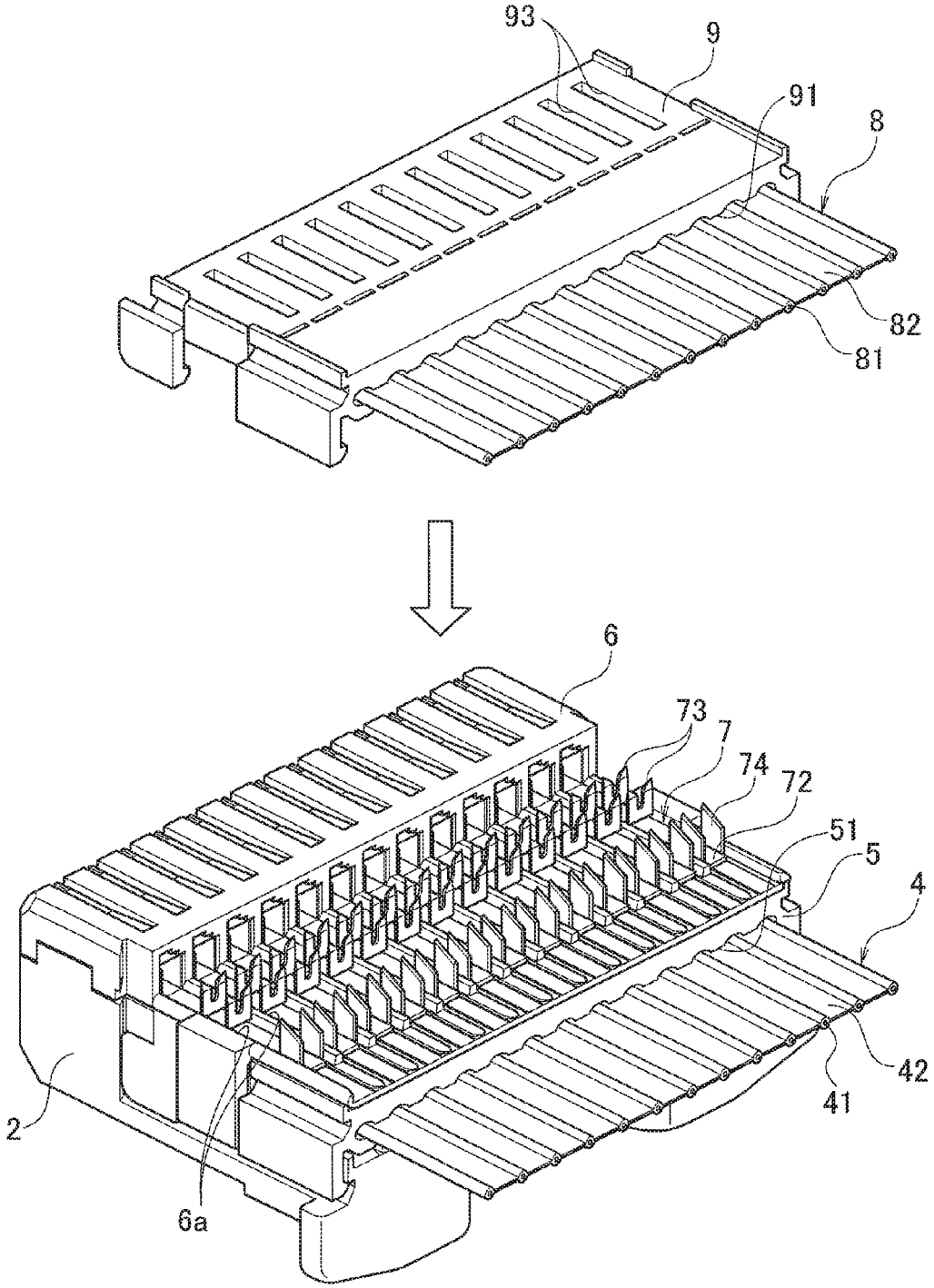
FIG. 16 is a perspective view illustrating a process of mounting a second holder with a flat cable to an upper housing, according to an embodiment of the present invention.

Next, as illustrated in FIG. 14, the upper housing 6 is mounted on the lower housing 2, and as illustrated in FIG. 15, the lower housing 2 and the upper housing 6 which are integrated with each other is obtained. Then, as illustrated in FIG. 16, the second holder 9 with the second flat cable 8 is mounted on the upper housing 6. At this time, the second flat cable 8 is brought into pressure-contact with the plurality of second terminals 7 by the second holder 9, and the insulation displacement terminal portion 73 bites the conductor 81 through the cover 82 to be electrically connected.

In an assembly process having been described above, when the first and second flat cables 4 and 8 are brought into pressure-contact with the insulation displacement terminal portions 33 and 73, the conductors 41 and 81 are independently displaced owing to the slits 44 and 84 in a width direction. Thus, the difference between the pitch of the insulation displacement terminal portions 33 and 73 of the first and second terminals 3 and 7, and the pitch of the conductors 41 and 81 of the first and second flat cables 4 and 8 can be absorbed, respectively, and appropriate electrical connection can be obtained.

As described above, the first and second holders 5 and 9 are provided with the flat cable insertion chambers 51 and 91 into which the first and second flat cables 4 and 8 are inserted, and the cutting blade penetration holes 53 and 93 communicating with the cable insertion chamber 51, respectively, and the cutting blades 11 penetrates the cutting blade penetration holes 53 and 93 and forms slits 43 in the first and second flat cables 4 and 8. Thus, after the first flat cable 4 is inserted into the flat cable insertion chamber 51 of the first holder 5, the slits 43 are formed in the first flat cable 4 by the cutting blades 11 of the jig 10. Therefore, the slits can be formed in the first flat cable 4 without the dedicated expensive slitting apparatus. Similarly, the slits are formed also in the second flat cable 8. Thus, cost can be reduced. That is, when the slits 43 are formed, the first and second holders 5 and 9 are used as a holding portion for the first and second flat cables 4 and 8, so that the slitting apparatus can be reduced in cost.

Further, before insertion of the first and second flat cables 4 and 8, the terminal portions of the first and second flat cables 4 and 8 are not cut and do not loosen. Thus, assembling of the first and second flat cables 4 and 8 to the first and second holders 5 and 9 can be facilitated.

The cuts (slits 43) of the cover 42 are formed in a range including an area in which the insulation displacement terminal portions 33 of the first terminals 3 make pressure-contact with the conductor 41. Accordingly, the difference between the pitch of the insulation displacement terminal portions 33 and the pitch of the conductors 41 can be surely absorbed, and the insulation displacement terminal portion 33 is reliably brought into pressure-contact with the conductor 41 for appropriate electrical connection. Similarly, the cuts (slits) of the cover 82 are formed in a range including an area in which the insulation displacement terminal portions 73 of the second terminals 7 make pressure-contact with the conductor 81. Accordingly, the difference between the pitch of the insulation displacement terminal portions 73 of the second terminals 7 and the pitch of the conductors 81 can be surely absorbed, and the insulation displacement terminal portion 73 is reliably brought into pressure-contact with the conductor 81 for appropriate electrical connection.

The jig 10 having the plurality of cutting blades 11 penetrating the cutting blade penetration holes 53 and 93 can accurately and efficiently form the slits in the covers 42 and 82 of the flat cables 4 and 8.

The inside of the cable insertion chamber 51 can be visually confirmed through the cutting blade penetration holes 53 of the first holder 5, so that it is possible to check whether the slits are preferably formed in the cover 42. Similarly, the inside of the cable insertion chamber 91 can be visually confirmed through the cutting blade penetration holes 93 of the second holder 9, so that it is possible to check whether the slits are preferably formed in the cover 82.

In the present embodiment, the connection structure for the first and second flat cables 4 and 8 are applied to the connector 1. However, the present invention is not limited to the above description. For example, the connection structure may be applied to a connection structure for connecting the flat cables 4 and 8 to an in-vehicle device (vehicle interior lamp etc.).

In this way, the present invention includes various embodiments not described above. Therefore, the scope of the present invention is determined only by the invention identification matters according to claims reasonable from the foregoing description.

What is claimed is:

1. A flat-cable connection structure comprising:

a flat cable having a plurality of conductors spaced from each other and a cover covering the plurality of conductors;

a housing;

a holder having a flat cable insertion chamber for the flat cable to be inserted and a cutting blade penetration hole penetrating the flat cable insertion chamber;

an insulation displacement terminal portion fixed to the housing through the holder and sticking in the flat cable inserted into the flat cable insertion chamber; and a jig having a cutting blade penetrating the cutting blade penetration hole of the holder with the flat cable inserted into the flat cable insertion chamber and forming a slit in the cover between the plurality of conductors of the flat cable, wherein the insulation displacement terminal portion sticking in the flat cable having the slit formed by the cutting blade is in pressure-contact with a corresponding conductor of the plurality of conductors.

2. The flat-cable connection structure according to claim 1, wherein the slit is formed in a range including an area in which the insulation displacement terminal portion is in pressure-contact with the corresponding conductor of the plurality of conductors.

3. The flat-cable connection structure according to claim 1, wherein the jig further includes:

a base having the cutting blade standing upright;

a front wall standing upright at a front end of the base and positioning the holder; and a pair of side walls standing upright at both side ends of the base and positioning the holder.

* * * * *